US005404777A

United States Patent [19]

Skaar et al.

[11] Patent Number: 5,404,777

[45] Date of Patent: * Apr. 11, 1995

[54] YIELD IMPROVING FOOD SLICING METHOD AND SLICING APPARATUS

[75] Inventors: Gary R. Skaar, Marshall; Terry L. Holmes, Monona; Dennis G. Flisram, Plainfield, all of Wis.

[73] Assignee: Oscar Mayer Foods Corporation, Madison, Wis.

[ * ] Notice: The portion of the term of this patent subsequent to Jun. 14, 2011 has been disclaimed.

[21] Appl. No.: 213,494

[22] Filed: Mar. 14, 1994

Related U.S. Application Data

[63] Continuation of Ser. No. 968,622, Oct. 29, 1992, Pat. No. 5,320,014.

[51] Int. Cl.[6] ..... B26D 1/28

[52] U.S. Cl. ..... 83/42; 83/355; 83/444; 83/596; 83/676; 83/932

[58] Field of Search ..... 83/355, 437, 444, 596, 83/665, 666, 676, 932, 13, 42

[56] References Cited

U.S. PATENT DOCUMENTS

| | | | |
|---|---|---|---|
| 1,401,978 | 1/1922 | Hall . | |
| 1,909,029 | 5/1933 | Walter . | |
| 2,966,186 | 12/1960 | Garapolo . | |
| 3,162,226 | 12/1964 | Toby et al. . | |
| 3,299,925 | 1/1967 | McBrady et al. . | |
| 3,468,356 | 9/1969 | Brauns . | |
| 3,631,907 | 1/1972 | Laska . | |
| 3,762,257 | 10/1973 | Mathews, Jr. | 83/364 |
| 3,897,020 | 7/1975 | Knecht | 241/292.1 |
| 4,428,263 | 1/1984 | Lindee et al. | 83/354 |
| 4,466,991 | 8/1984 | Andreev et al. . | |
| 4,523,501 | 6/1985 | Mengel | 83/42 |
| 4,638,697 | 1/1987 | Hager et al. | 83/356.3 |
| 4,685,364 | 8/1987 | Scheflow et al. | 83/68 |
| 4,805,503 | 2/1989 | Yokokawa | 83/355 |
| 4,913,019 | 4/1990 | Hayashi | 83/367 |
| 4,966,332 | 10/1990 | Laska | 241/199.7 |
| 5,065,656 | 11/1991 | Flisram | 83/356.003 |
| 5,136,908 | 8/1992 | Callandrello | 83/703 |

FOREIGN PATENT DOCUMENTS

| | | |
|---|---|---|
| 202777 | 11/1986 | European Pat. Off. . |
| 294373 | 5/1914 | Germany . |
| 3304270 | 8/1984 | Germany . |
| 3635572 | 2/1988 | Germany . |
| 8813952 | 2/1989 | Germany . |

*Primary Examiner*—Eugenia Jones

*Attorney, Agent, or Firm*—Lockwood, Alex, Fitzgibbon & Cummings

[57] ABSTRACT

Method and apparatus for improved slicing of large food sticks, loafs and the like are provided. A slicing blade having a flat top surface or top flat land width along its cutting edge provides generally longitudinal forces on the food product being sliced, which forces are in a direction generally opposite to the direction through which the food products are fed through a slicing apparatus. The slicing apparatus includes an orifice assembly or other arrangement for imparting generally laterally directed forces on the food products being sliced. The invention is particularly important in improving handling of the butt ends of those products. Fast feed rates can be practiced without experiencing jamming, yields are increased, slicing line utilization is enhanced, and sanitary conditions are more easily maintained.

11 Claims, 3 Drawing Sheets

YIELD IMPROVING FOOD SLICING METHOD AND SLICING APPARATUS

This application is a continuation of application Ser. No. 968,622, filed Oct. 29, 1992, now U.S. Pat. No. 5,320,014.

BACKGROUND AND DESCRIPTION OF THE INVENTION

The present invention generally relates to the slicing of food products and more particularly to a method and apparatus for conducting such slicing on food products such as large meat sticks. The invention involves continuously feeding meat sticks or the like toward, into and through a slicer in a manner whereby the leading end of the next stick to be sliced exerts feeding direction pressure upon, and typically is in virtual engagement with, a severed butt end of the downstream stick which has been substantially completely sliced into stacks of sliced products such as stacks of sliced luncheon meat. Meat sticks are thus handled even at particularly fast feed rates and without experiencing jamming, reduced yields and poor slicing line utilization typically experienced when continuously feeding large meat sticks through industrial slicers. The advantages of the invention are especially significant when the food sticks are frozen.

With certain products such as food products that are processed in large sticks, blocks, chubs, loafs or the like, it is often desirable to handle these large masses in a frozen or partially frozen state. Various reasons for processing under such conditions include ease of manipulation of the sliced products so as to form neat stacks of slices due to the fact that frozen or partially frozen slices will present low friction interfaces with each other whereby they are readily moved into alignment. Refrigerated but non-frozen food products such as luncheon meats for example sever into slices which are difficult to mechanically move once one slice engages another slice or other surface, thereby rendering extremely difficult the neatening of stacks which are produced by conventional slicing equipment. While frozen or partially frozen products are typically preferred for handling and other reasons before and after the slicing operation itself, frozen products traditionally present a more difficult slicing problem than do non-frozen but otherwise identical products being sliced on a continuously fed slicer of the type which does not utilize a butt gripper. Problems associated with continuous slicing, such as butt pull through, can be reduced by raising the temperature of the product. However, raising the temperature of the product being sliced normally is not a viable option because of the importance of proper low temperatures to handling of the slices.

Approaches have been used in the past for continuously slicing these types of products, but the yields have been disappointingly low and the waste has been greater than desired. Improvements in yields and waste factors often can be gained by significantly reducing the feeding speed of the slicing apparatus. Traditional approaches have avoided continuous end-to-end engaging passage of consecutive frozen or partially frozen sticks through the slicing apparatus by using butt gripping assemblies that positively feed each stick up until the butt gripper approaches the blade. This spaces the sticks apart and, in effect, slices one stick at a time. While these approaches have been proven effective in handling of the individual sticks through the slicers with little jamming, these traditional approaches result in inefficient utilization of the slicing equipment when compared with the potential efficiencies of a truly continuous feeding approach.

An approach which has been attempted in seeking to capture the potential efficiencies of continuous feed arrangements includes the use of a so-called orifice assembly. An orifice assembly is intended to support a food stick (primarily laterally) or the like as it passes through the slicer. Typically, an orifice assembly includes a cylindrical member or other member having a peripheral shape corresponding to that of the stick or the like being sliced. This cylindrical or similarly shaped member has a leading edge which is very closely spaced from the slicing blade and is intended to provide some support for the stick during slicing. Some approaches suggest using orifices having smooth inside surfaces, while others suggest somewhat roughened surfaces for contacting the sticks or the like. Pressure applied to the sticks can be adjusted in an effort to better hold the butt; however, if too much pressure is applied, the hide can be squeezed off of the product by the orifice assembly, rendering the product unacceptable, and still have uncontrolled butt end pull through subsequently resulting in product jams.

It has been found that the use of an orifice assembly alone does not remedy the problems associated with continuous product slicing, especially insofar as butt end pull through and slicer jamming and disappointing yield and waste experiences are concerned. Typically about 6 to 8 linear inches, often up to about 12 inches, of the butt end of the stick can be lost. Another consequence of frequent jams and pull through is associated with the need for an operator to interact with the slicer such as by using a hand to remove a jammed butt end, creating a condition that can lead to potential reduction of sanitary conditions, which can shorten the shelf life of the sliced products.

It has been found that by combining a number of features, significant improvements in slicing of frozen food products, particularly frozen luncheon meat sticks or loafs, are attained. By the approach in accordance with the present invention, the yield of acceptable, commercially salable sliced product is enhanced considerably and the quantity of product waste is reduced significantly. Furthermore, operational characteristics of the slicing devices are enhanced. More particularly, by proceeding in accordance with the present invention, it is possible to slice frozen or partially frozen food sticks on a truly continuous basis and at enhanced feed and slicing rates without incurring the inefficient and serious problem of jamming of the slicing equipment due in large measure to having the slicing equipment pull a severed frozen chub out of the orifice assembly as a large chunk of product that cannot be adequately handled by the slicing blade, resulting in jamming of the slicing equipment. Jamming, of course, necessitates a shut-down of the slicing line and perhaps associated machinery upstream and/or downstream of the slicing line in order to clear the jam, often requiring manual intervention by an operator, which can itself reduce the shelf life of the sliced product.

In summary, the present invention achieves these objectives and provides advantageous results along these lines by processing large food sticks, loafs and the like in a frozen state and at a relatively fast continuous feed rate through slicing apparatus which provides some lateral support for the loaf or stick at a location substantially adjacent to or very closely spaced from a slicing blade having specific properties. The blade of the invention features a flat top surface of the slicing blade which is substantially parallel to the cut surface of the frozen stick or the like being sliced. The flat top surface has a minimum average width along the cutting edge of the blade which provides what has been found to be an adequate degree of support for the sticks being continuously sliced, even when the sticks have been sliced to their butt ends. This combination has been found to control butt pull-through at the slicer and has been found to significantly increase yield and reduce waste of the products being sliced, while enhancing slicing line utilization.

It is a general object of the present invention to provide an improved method and apparatus for continuously slicing large food products in the form of sticks, chubs, loafs, chunks and the like.

Another object of this invention is to provide an improved continuous slicing method and apparatus which includes the use of a slicing blade having a flat top surface or flat land width surface which engages and supports the food product during the actual continuous slicing of same.

Another object of this invention is to provide an improved method and apparatus for slicing frozen food products on a continuous basis in order to improve the yield of product processed through a slicer in a frozen or partially frozen state while tolerating relatively fast slicing speeds.

These and other objects, features and advantages of this invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
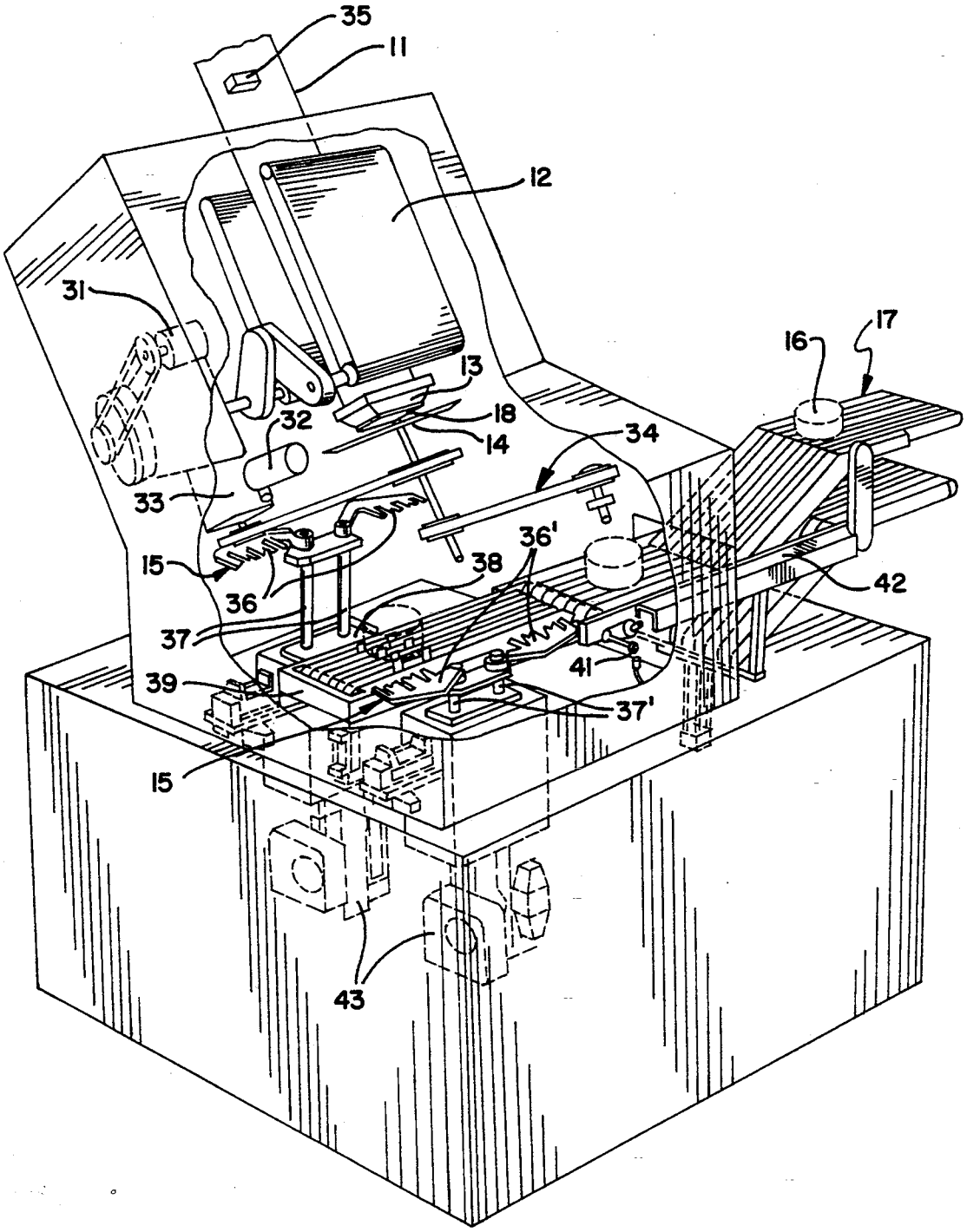
FIG. 1 is a perspective view, partially broken away, of a slicing .apparatus incorporating the present invention.

An apparatus for continuously feeding food sticks, rolls, loafs, chubs, chunks or the like, for severing same into slices, and for collecting the slices into a plurality of stacks is generally shown in FIG. 1. A stick of frozen or partially frozen product 11 is generally shown within a feeding assembly 12 of generally known construction, further details of the illustrated feeding assembly 12 being shown in FIG. 5. Each stick 11 of frozen or partially frozen food product is fed by the feeding assembly 12 to an orifice assembly 13 for engagement with a slicing blade 14. Product slices accumulate on a catcher assembly, generally designated as 15. Sliced stacks 16 collect on conveyor assembly, generally designated 17.

Figure 6:
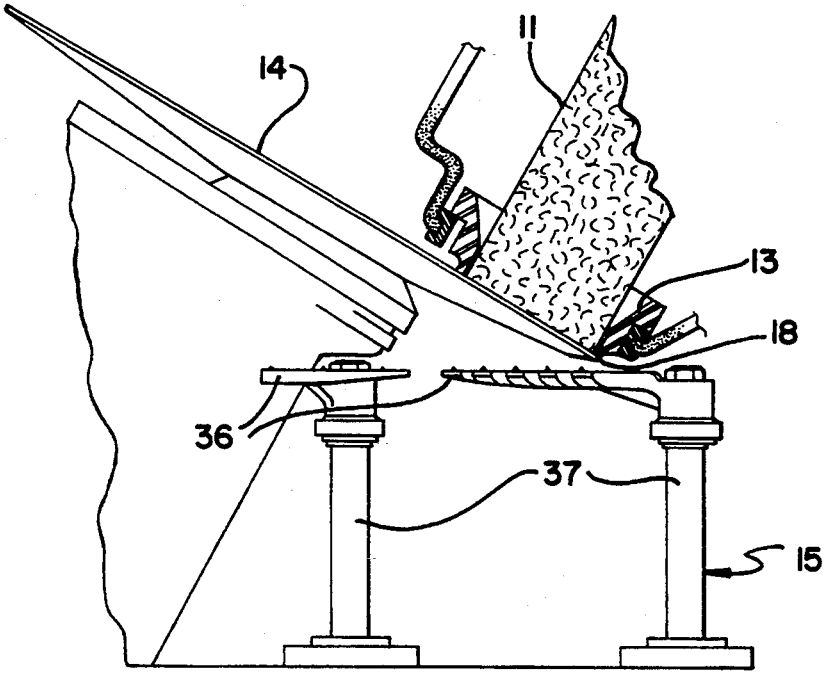
FIG. 6 is an enlarged detailed elevational view, partially in cross-section, showing operational details of the apparatus of FIGS. 1 and 5.

It will be seen from FIG. 6 that the stick 11 is severed by slicing blade 14 at a location closely adjacent to and only slightly spaced from lip 18 of the orifice assembly 13. In an important aspect of the invention illustrated in FIGS. 2 through 4, working side 21 of the slicing blade 14, which is the side of the blade that faces food product 11 during the slicing operation, includes a body portion and a flat top surface or top flat land width 22 which is virtually parallel to the cut surface of the food product 11 being sliced. Body portion of working side 21 of the slicing blade 14 is generally dish-shaped or somewhat concave whereby a clearance area 23 (FIGS. 3 and 4) is provided between the food product 11 being sliced and the slicing blade 14, particularly the body portion of its working side 21, while the flat top surface 22 is in contact with the food product 11 as it is being sliced. The formation of a slice 19, including the interaction between the food product 11 and the various surfaces of the edge portion of the slicing blade 14, is illustrated in FIG. 3, whereby the slice 19 is eventually thrown by the blade 14 slicing through the frozen or partially frozen food stick 11.

Figure 4:
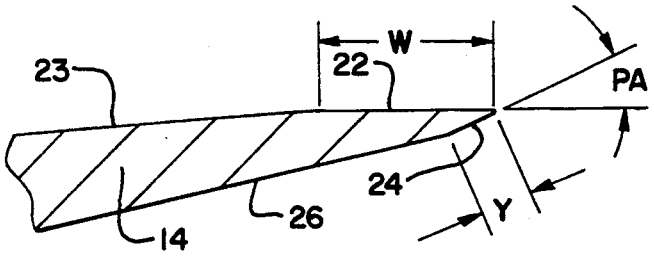
FIG. 4 is an enlarged view of the working edge of the blade shown in FIG. 2, taken along the line 4—4.

Edge portion of the slicing blade 14 is shown in greater detail in FIG. 4. The flat top surface or top flat land surface 22 has an average width "W". It will be appreciated that flat top surface 22 is formed by a grinding operation. Because of the relatively large size and relatively thin thickness of the slicing blade 14, it is difficult to provide a flat top surface 22 that is of uniform width throughout its extent. The average width "W" is determined by measuring the width of the flat top surface 22 a plurality of times, the measurements being one inch apart along the extent of the flat top surface 22. These measurements are then totalled and divided by the number of measurements in order to obtain the average width. In order that the flat top surface 22 provides adequate support to hold the frozen food product 11 during slicing, the average width should be between about 0.1 inch and about 1 inch. A typically preferred average width is between about 0.2 inch and about 0.5 inch. The blade of the invention exhibits reduced pull on the food sticks during slicing, when compared with other slicing mechanisms.

Also included is a primary bevel surface or bottom flat land width 24. The top flat land width 22 and the bottom flat land width 24 intersect each other at a primary angle "PA". The back side 25 of slicing blade 14 includes a secondary bevel 26. Primary bevel will typically have an average width "Y" which typically ranges between about 0.08 inch and about 0.11 inch. A preferred primary angle "PA" is between about 27° and about 29°. It will be appreciated that the actual values of these parameters will vary depending upon the product being sliced.

Figure 3:
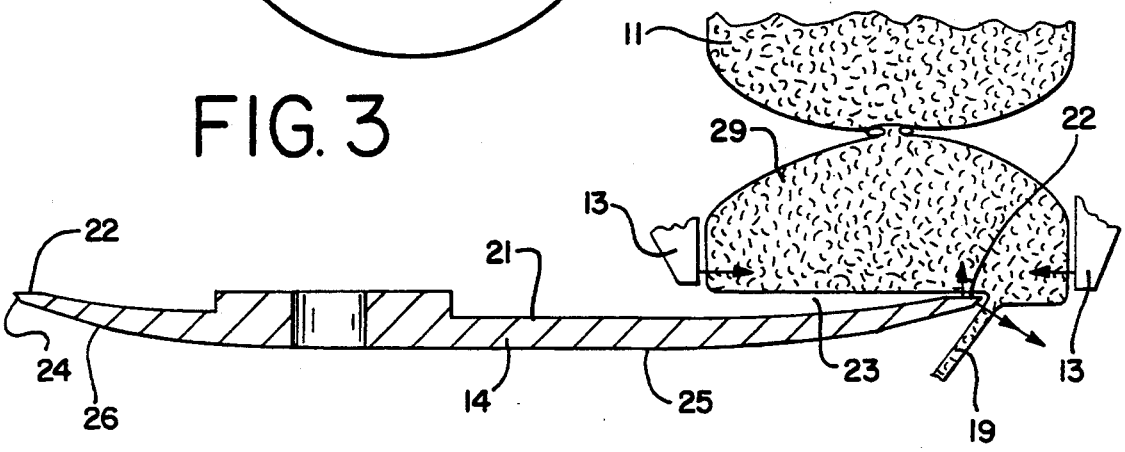
FIG. 3 is a cross-sectional view of the blade illustrated in FIG. 2.

The advantageous effect of the combination of the present invention is generally illustrated in FIG. 3. It will be appreciated, of course, that the illustrated blade will cycle entirely through the food stick 11 and that the slicing blade 14 will have sliced entirely through the stick of meat 11 by the time the longest leg of the blade 14 has rotated into the food stick 11. In this respect, FIG. 3 is somewhat schematic in that the blade is shown in an orientation where it has not yet fully rotated through its involute blade surface to fully sever a slice. This drawing illustrates the slicing action in progress. Once the blade has rotated through its slicing phase, as well known in the art, the slice 19 is completely severed from the food stick 11, rather than only partially severed as illustrated in FIG. 3.

The upwardly directed arrow in FIG. 3 illustrates the holding force provided by the flat top surface or top flat land width 22 upon the food stick 11. Similarly, the horizontally directed arrows illustrate the force applied onto the food stick 11 by the orifice assembly 13. It is believed that these forces combine to provide the major impetus for the advantages achieved by the present invention. It was observed, for example, that the forces illustrated by these arrows support even the butt end 29 which remains during the slicing of a food stick whereby same is sliced more thoroughly than practiced heretofore. Moreover, this is accomplished while butt end 29 is engaged by and being pushed into the slicing device by the following food stick 11 which is within the feeding assembly 12. In accordance with the present invention, the slicing blade 14 contacts the food stick 11 and remains in contact with it for a length of time greater than accomplished heretofore. It is important that the flat top surface 22 have an average surface area or width that is adequate to support the frozen or partially frozen product in achieving this advantage of the invention.

The downward force imparted to the food stick 11 and/or frozen or partially frozen food butt 29 by the primary bevel angle "PA" is controlled by the invention. Otherwise, this downward force, which is illustrated by the double-headed arrow in FIG. 3, can result in uncontrolled movement of the food product during slicing, particularly when that food product is a frozen butt end 29. This uncontrolled movement results in poor slicing yields, slicer jam-ups, poor slicing line utilization, and a potentially reduced shelf life for the sliced products. Problems of these types are particularly evident in commercial slicers such as illustrated generally in FIGS. 1, 5 and 6 which are sold commercially by Formax, Inc. for continuous slicing and which experience these difficulties including butt pull-through and poor slice shape, especially when slicing frozen or partially frozen lunchmeat sticks. To a certain extent, these difficulties can be reduced by reducing the speed of operation of the slicing equipment, which, of course, is an example of poor slicing line utilization.

These frozen or partially frozen sticks are at a temperature equal to or less than about 35° F., typically between about 10° F., and about 35° F., often between about 10° F. and about 27° F. Depending upon the makeup of the stick and the conditions under which it was subjected to a low temperature environment, a stick could be of generally uniform temperature throughout or could be lower in temperature at its rind or crust or at its center. Thus, these temperatures will vary somewhat depending on actual conditions and products.

With respect to the types of slicing mechanisms and blades therefor, besides the involute slicing blade 14 shown in the drawings, other systems can be used. Included is a blade having a multiple cutting surface such as that illustrated in U.S. Pat. No. 5,065,656, incorporated by reference hereinto, wherein each revolution of the blade severs more than one slice, for example two slices for each revolution of a double cutting surface blade. Other slicing equipment utilize a circular blade which operates in a generally orbital path in order to provide a severance mode and a gap between severance modes whereby the product being sliced is moved into the path of the blade between actual slicing. Devices of these types are known in the art. It can be desirable to coat any of these blades with materials that have a lower coefficient of friction than, for example, stainless steel, in order to reduce drag between the blade and the product being sliced. This can enhance the neatness of the stacks initially made by the slicer. Coatings can also increase the working life of the blade between needed sharpenings and can also retard rusting and/or corrosion. A typical coating in this regard is or includes titanium nitride.

Figure 5:
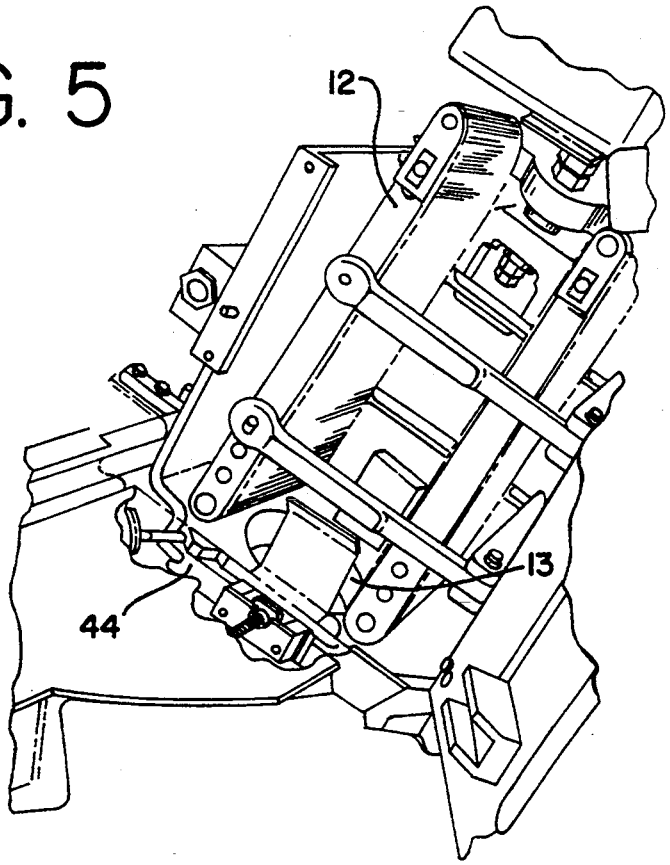
FIG. 5 is a perspective, detail view of the feeding and orifice components of the apparatus shown in FIG. 1.

FIGS. 1, 5 and 6 illustrate one of the types of slicing devices that can advantageously practice the present invention. A known blade driving mechanism, partially broken away, is illustrated as including a feed encoder 31, a stepping motor 32, a variator 33, and drive components generally designated 34 including a brake mechanism. A sensor or switch 35 is provided for detecting the location of sticks 11 passing through the feeding assembly 12.

Catcher assembly 15 includes a plurality of stacking grids or indexing platforms 36, 36'. The stacking grids 36, 36' move between the up position of the backside grids as shown in FIG. 1 and the down position of the front side grids 36'. Also, the grids 36, 36' rotate along the respective axes of their support rods 37, 37' so that one of the pairs of grids is out of the travel path of the slices while the other pair of grids is receiving the stack being formed and moving toward depositing the formed stack onto protruding pins 38 which typically serve as a platform for a scale mechanism. A scale conveyor 39 operates in a generally known manner by pivoting an axis 41 to thereby lift a formed stack off of the protruding pins 38 in order to convey same onto downstream conveyor assembly 42.

Grid encoders 43 assist in the operational timing of the unit. The spacial relationship between the slicing blade 14 and the catcher assembly 15 is perhaps best illustrated in FIG. 6. FIG. 5 illustrates that an adjusting mechanism 44 is available for modifying the pressure exerted on the stick 11 by the orifice 13. Generally speaking, orifice 13 includes components, such as split halves, which move laterally with respect to the stick in order to thereby modify the pressure applied by the orifice assembly 13 in a generally known manner.

The following examples generally illustrate advantageous results achieved by the present invention under commercial scale operating conditions.

EXAMPLE 1

A slicing apparatus of the type generally shown in FIG. 1 was used to conduct tests under commercial operation conditions. In one set of tests (Test I) a unit as shown in the drawings, with one exception, was used. Although orifice assembly was included, the involute blade utilized did not include the flat top surface or top flat land width 22. Otherwise, the blade was as illustrated in FIGS. 2 through 4.

Frozen sticks were run through this unit, and it was determined that if an rpm value greater than 950 rpm was used, the result was poor, unmanageable stacks. During Test I, 41 sticks were fed. The test was started with these sticks running end-to-end on a continuous, contacting basis as discussed herein. After the apparatus jammed 15 times, the test was modified so as to provide gaps between the sticks, this being needed in order to keep the apparatus running without Jamming.

Figure 2:
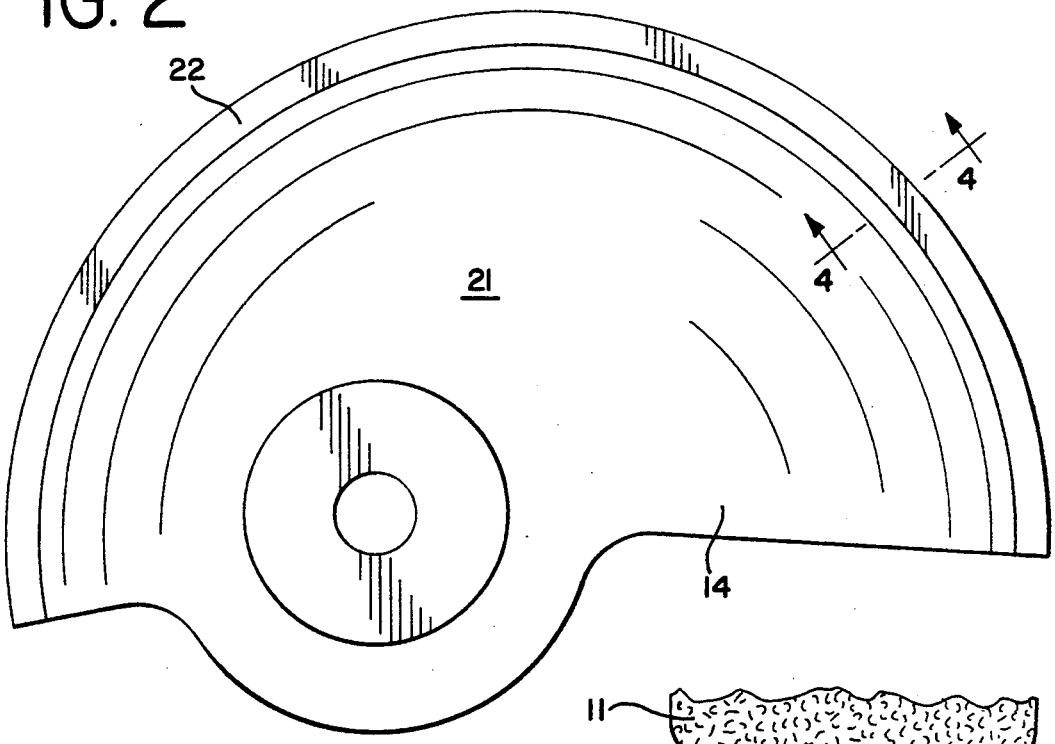
FIG. 2 is a plan view of a typical slicing blade incorporating the present invention.

In Test II, the apparatus was the same as that for Test I, except the slicing blade 14 included the flat top surface or top flat land width 22 as shown in FIGS. 2 through 4. The average width "W" thereof was 0.270 inch. It was determined that excellent slicing characteristics and line utilization could be achieved at 1050 rpm. Again, 41 sticks were fed through this apparatus in accordance with the present invention, and all 41 sticks were fed through the apparatus in end-to-end continuous, contacting fashion as described herein. No jamming occurred. In both Test I and Test II, the products sliced and stacked were large frozen turkey bologna sticks at 17° F. Test I and Test II were run at the same orifice pressure, which is the pressure applied to the sticks by the orifice assembly, and the orifices themselves were the same.

| | Test Results | | | |
|---|---|---|---|---|
| Blade RPM | Test I 950 | | Test II 1050 | |
| | Lbs | % | Lbs | % |
| Product to Slicer | 1470 | | 1472 | |
| No. 1 Product | 1222 | 83.1 | 1368 | 92.9 |
| Rework | 242.2 | 16.5 | 89.4 | 6.1 |
| Overfill | 13.2 | 0.9 | 15.9 | 1.1 |
| Inedible | 5.0 | 0.3 | 9.1 | 0.6 |
| Unacceptable | −12.6 | 0.8 | −10.2 | −0.7 |
| Total | 1469.4 | 100.0 | 1466.5 | 100.0 |

| | Rework Analysis | | | |
|---|---|---|---|---|
| | Test I | | Test II | |
| Defect Description | Lbs | % | Lbs | % |
| Thick & Thin | 143.2 | 59.1 | 18.2 | 20.3 |
| Butt Ends (Small Diameter) | 25.1 | 10.4 | 62.1 | 69.5 |
| Torn Edges | 14.2 | 5.8 | 0.0 | 0.0 |
| Jam-Up/Slicer Clean Out | 59.9 | 24.7 | 9.1 | 10.2 |
| Total | 242.4 | 100.0 | 89.4 | 100.0 |

It will be particularly noted that the yield of commercially acceptable stacked slices according to Test I was 83.1%, while that for Test II was 92.9%, representing an improvement of 9.8%. It will also be noted that, with Test I, the primary rework defects related to the problem of butt pull-through, this phenomenon being the cause of thick and thin slices and jamming. For Test II, these defects were decreased dramatically, the primary reason for rework being slices that were too small in diameter to meet specific specifications. The smaller diameters were due to the fact that, in Test II, the butt ends themselves were actually sliced, resulting in slices that were acceptable except for their diameter. Also, while a significant quantity of torn edges were experienced in Test I, no such problem was experienced in Test II. The slicing speed was increased 10% when comparing Test II with Test I.

EXAMPLE 2

Tests were run on a slicing apparatus of the type manufactured by Great Lakes. Frozen turkey bologna sticks were run at the relatively slow speed of 450 rpm. This device had a blade structure generally as shown in FIGS. 2 through 4, including a flat top surface or top flat land width 22, but it was not equipped with an orifice assembly. This apparatus was equipped with a deck or disc beyond and close to the slicing blade, this feature being provided in an effort to support the butt portions during slicing. Satisfactory slicing was obtained at these relatively slow slicing speeds, but only when the product was refrigerated and not frozen. Tests run on frozen turkey bologna sticks resulted in pull-through of the butts to an extent not acceptable for commercial practices. Also, the average width of the top flat land width of the blade used in this device was 0.19 inch.

It will be understood that the embodiments of the present invention which have been described are illustrative of some of the applications of the principles of the present invention. Numerous modifications may be made by those skilled in the art without departing from the true spirit and scope of the invention.

We claim:

1. A method for continuously slicing a stream of food sticks, comprising the steps of:

feeding on a continuous-flow basis in end-to-end engagement with each other a plurality of large food sticks toward and into a slicing location;

slicing at the slicing location the food sticks fed during the feeding step, said slicing step including continuously slicing the plurality of food sticks, the slicing step proceeding while the leading end of one stick exerts pressure in the feeding direction on the preceding food stick including a severed butt end thereof located upstream of the slicing location;

said slicing step including engaging a portion of the food stick being sliced with a blade having a generally concave non-severing body portion and a severing flat top surface having an average width of at least about 0.1 inch which is substantially parallel to the food stick cut surface being sliced and which defines an outermost perimeter edge of the generally concave body portion, the engaging step providing a holding force to support each food stick by the flat top surface during slicing of each food stick, said holding force of the engaging step being directed generally perpendicularly to said cut surface being sliced of each said food stick;

laterally supporting the longitudinal side of said severed butt end of the food stick during said slicing step; and said feeding, slicing, engaging and laterally supporting steps combine, without additional support for the food sticks, to continuously slice an end-to-end flow of food sticks while substantially eliminating jamming of butt ends during said feeding and slicing steps and while significantly reducing the amount of food waste generated during said feeding and slicing steps.

2. The method in accordance with claim 1, wherein the flat top surface has an average width of between about 0.1 inch and about 1 inch.

3. The method in accordance with claim 1, wherein the flat top surface has an average width of at least about 0.2 inch.

4. The method in accordance with claim 1, wherein the flat top surface has an average width of between about 0.2 inch and about 0.5 inch.

5. The method in accordance with claim 1, wherein said slicing step includes using a blade having a surface which is coated with a material having a coefficient of friction less than that of the material out of which the blade is made.

6. The method in accordance with claim 5, wherein said material which coats the blade includes titanium nitride.

7. An apparatus for slicing a continuous stream of food sticks, comprising:

a slicing assembly for severing large sticks of meat or other food products into slices and stacking said slices into stacks of slices;

means for feeding a food stick to the slicing assembly;

orifice means for receiving and generally laterally supporting a leading portion of said food stick, said orifice means having an opening through which said food stick passes;

said slicing assembly having a blade member, said blade member engages said food stick and severs said food stick into said slices, said blade member having a generally concave, non-severing body portion and a severing edge portion, said edge portion being a flat portion radially projecting beyond and defining an outermost perimeter edge of said generally concave body portion, said orifice means being located upstream of said blade member;

said flat portion of the edge portion of the blade member is a flat top surface which engages said food stick and is generally parallel to the cut surface of the food stick being sliced, said flat top surface having an average width adequate to impart a holding force to generally longitudinally support said food stick which it engages when said blade member severs the food stick into slices, said average width of said flat top surface being not less than about 0.1 inch; and said orifice means and said flat top surface combine to define means for substantially eliminating jamming of a butt end of the food stick within the slicing assembly by laterally supporting the leading portion of the food stick and simultaneously supporting the cut surface of the food stick in a direction generally perpendicular thereto without additional supporting means for the food stick.

8. The apparatus in accordance with claim 7, wherein said average width of said flat top surface is not less than about 0.2 inch.

9. The apparatus in accordance with claim 7, wherein said average width of said flat top surface is between about 1 inch and about 1 inch.

10. The apparatus in accordance with claim 7, wherein said average width of said flat top surface is between about 0.2 inch and about 0.5 inch.

11. The apparatus in accordance with claim 7, wherein said blade member has a coating including titanium nitride.

* * * * *

UNITED STATES PATENT AND TRADEMARK OFFICE

CERTIFICATE OF CORRECTION

PATENT NO. : 5,404,777

DATED : April 11, 1995

INVENTOR(S) : Gary R. Skaar, Terry L. Holmes and Dennis G. Flisram

It is certified that error appears in the above-indentified patent and that said Letters Patent is hereby corrected as shown below:

Col. 3, line 41, "slicing .apparatus" should read --slicing apparatus--; line 48, "4--4" should read --4-4--.
Col. 6, line 68, replace "Jamming" with --jamming--.
Col. 7, line 7, "41" (bold) should read --41--.
Col. 10, line 20, "about 1 inch and about 1 inch" should read --about 0.1 inch and about 1 inch--.

Signed and Sealed this

Twentieth Day of August, 1996

*Attest:*

Bruce Lehman

BRUCE LEHMAN

*Attesting Officer*

*Commissioner of Patents and Trademarks*